US006095153A

United States Patent [19]

Kessler et al.

[11] Patent Number: 6,095,153

[45] **Date of Patent: *Aug. 1, 2000**

[54] VAPORIZATION OF VOLATILE MATERIALS

[76] Inventors: Stephen B. Kessler, 122 Calamint Hill Rd. North, Princeton, Mass. 01541; T. David Marro, 26 Long Hill Rd., Magnolia, Mass. 01930

[ * ] Notice: This patent issued on a continued prosecution application filed under 37 CFR 1.53(d), and is subject to the twenty year patent term provisions of 35 U.S.C. 154(a)(2).

[21] Appl. No.: 09/100,658

[22] Filed: Jun. 19, 1998

Related U.S. Application Data

[60] Provisional application No. 60/050,254, Jun. 19, 1997.

[51] Int. Cl.[7] ..... A24F 1/22

[52] U.S. Cl. ..... 131/194; 131/272; 131/273; 131/330

[58] Field of Search ..... 131/194, 329, 131/330, 273, 328, 226, 333, 348, 272, 195, 198.1, 198.2; 128/203.26, 202.21

[56] References Cited

U.S. PATENT DOCUMENTS

| | | | |
|---|---|---|---|
| 5,144,962 | 9/1992 | Counts et al. | 131/194 |
| 5,224,498 | 7/1993 | Deevi et al. | 131/194 |
| 5,479,948 | 1/1996 | Counts et al. | 131/194 |

*Primary Examiner*—James Derrington
*Assistant Examiner*—Rob McBride
*Attorney, Agent, or Firm*—Bruce F. Jacobs

[57] ABSTRACT

Vaporization of volatile materials while avoiding combustion and denaturation of such material provide an alternative to combustion as means of volatilizing bioactive and flavor compounds to make such compounds available for inhalation without generating toxic or carcinogenic substances that are by-products of combustion and pyrolysis.

10 Claims, 1 Drawing Sheet

VAPORIZATION OF VOLATILE MATERIALS

This application claims the benefit of U.S. Provisional Application Ser. No. 60/050,254, filed Jun. 19, 1997

BACKGROUND OF THE INVENTION

Combustion of substances to enable the inhalation of volatile materials contained therein has been practiced for millennia. In more recent times, the health effects of this practice have been extensively studied from an epidemiological viewpoint and the hazards of smoking tobacco have been well documented. Combustion of tobacco, cannabis or other "smoking materials," is accompanied by oxidation, hydrogenation, cracking, distillation and sublimation. The first three of these processes result in the formation of chemical compounds not present in the original source material and it is these products of combustion and pyrolysis that are generally recognized as the most hazardous aspect of smoking. By heating a substance such that distillation and sublimation occur without combustion, only those compounds present in the source material which are sufficiently volatile to boil or sublime at a given temperature will be available for inhalation. By eliminating combustion as a heat source, the health risks and benefits of the volatile compounds present in a source material can be evaluated on their own merits. For example, a study performed by the National Toxicology Program and overseen by the U.S. Food and Drug Administration and the National Cancer Institute concluded that the active principal of cannabis, tetrahydrocannabinol, does not cause cancer and may have protected laboratory animals against malignancies. Nicotine, the active principal of tobacco, is highly toxic and is considered addictive, but it is not carcinogenic. Whether these volatile compounds and others ought to be administered to humans is a question that could be better addressed if a simple means existed for vaporizing the compounds in the absence of combustion.

The advantages of volatilization and inhalation as a drug delivery method include: simplicity, selective extraction of bioactive compounds from crude plant sources and the rapid uptake of substances by the lungs. This rapid uptake leads in turn to bloodstream levels of bioactive substances quickly reaching effective concentrations. The rapidity of action is very desirable to a patient who is seeking relief from symptoms whose onset is sudden and cannot be anticipated. Compared with oral administration, relatively smaller doses can be administered, having a shorter duration of action and enabling the patient to "titrate" the dosage over time. Titrating the dosage can minimize total dosage, thereby reducing the probability of undesirable side effects. These advantages apply to both pure compounds and crude mixtures of compounds.

U.S. Pat. Nos. 4,141,368 and 4,303,083 describe electrical devices for volatilizing desired components of smoking materials without combustion. The first uses an incandescent light bulb as a heating source while the second uses a rheostat or thermostat controlling an electrical resistance heating element. While the second offers the possibility of fine tuning the operating temperature, the adjustment would have to be made repeatedly to compensate for variations in one or more of ambient temperature, rate of inhalation, and voltage in the power source. Since each adjustment requires trial and error, overshooting would lead to the undesirable effect of incomplete combustion. Also, both devices require continuous heating of the source material which generates vapors whether or not inhalation is occurring, thereby both wasting the source material and making accurate dosage difficult. Thus, while recognizing the advantages of avoiding combustion, the devices do not provide means for precise and reproducible temperature control that is required to achieve volatilization without combustion.

U.S. Pat. No. 4,735,217 avoids waste of source material by providing an on/off switch that can be controlled by the user to switch the power off when inhalation is not occurring. However there is no temperature adjustment capability and the principle of switching the power on and off can only be effective with a low mass heating element which makes reproducible temperature control difficult to obtain.

U.S. Pat. Nos. 5,249,586 and 5,388,594 describe electrical heating devices to vaporize tobacco flavor substances contained in artificial cigarettes. The devices are not intended to cause combustion but no means to accurately control temperature are provided. U.S. Pat. No. 5,060,671 falls into the same general category and discloses self-contained electrically heated "smoking devices." The only temperature control is obtained by controlling the amount of time that the heater is energized. The "flavor medium" should be heated to a temperature of 100 to 600° C. and, preferably, 300 to 400° C. U.S. Pat. No. 5,224,498 describes a heating element having a predetermined electrical resistance which is intended to control the temperature of operation of the above devices. Intended operating temperatures are 100 to 600° C., preferably 250 to 500° C. U.S. Pat. No. 5,372,148 teaches a simple electronic controller for use in the above "smoking articles." While the controller delivers a measured amount of energy to a heating element, it contains no temperature sensor or temperature control means, thereby resulting in temperature variation depending upon ambient conditions.

U.S. Pat. No. 5,564,442 teaches that a charge of tobacco in a vaporizer device is to be brought to combustion temperature, thus the device does not avoid the hazards caused by combustion.

Several devices have been suggested to utilize combustion as a heat source, while isolating the material to be vaporized from the fuel material. U.S. Pat. No. 4,219,032 discloses a device resembling a standard tobacco pipe but adding a separate chamber containing e.g. charcoal fitted above the bowl to supply heat to the "smokeable substance." The device also includes a reservoir that may be partially filled with liquid to cool the vapors. U.S. Pat. No. 5,105,831 is a more recent example of this approach and features a carbonaceous fuel element and an "aerosol forming substance" packaged together in a form resembling a cigarette. The "aerosol forming substance" is held in a heat conductive container such that heat from the fuel source reaches it by conduction. Carbon monoxide is generated by the carbonaceous fuel and temperatures near the fuel reach 400 to 600° C.

Some other patents that use an isolated combustion source to generate vapors and/or aerosols include: U.S. Pat. Nos. 4,340,072, 4,474,191, 5,042,509, 5,099,861, 5,105,831, 5,156,170 and 5,345,951.

U.S. Pat. Nos. 4,922,901, 4,947,874 and 4,947,875, describe drug delivery, smoking, and flavor delivery articles comprising a reusable controller coupled with a disposable heating element. The heating element, having a specific surface area greater than 1.0 $m^2/g$, is impregnated with an aerosol forming material. The temperature control is time based or current modulation. No means of temperature sensing is described. The preferred temperature range given is 150 to 350° C., not to exceed 550° C. U.S. Pat. No. 5,388,574 discloses an alternative means of temperature control based upon the use of sensors or thermostats such as bimetallic strips.

U.S. Pat. No. 4,907,606 describes specially modified tobacco compositions and devices intended to heat the compositions and liberate nicotine by electricity, a gas burner, or by the mixing of liquids to liberate heat. The electrically heated version of the device includes a temperature sensor controlled by on/off switching of current. The device is intended for use with chemically modified tobacco which is capable of releasing nicotine at a relatively low temperature of about 30 to 200° C.

U.S. Pat. No. 5,388,574 is another example of an aerosol delivery article that is limited in applicability to specific formulations. The devices of this patent incorporate a first nebulizing stage and a second heating stage. Multi-component aerosol forming materials are introduced into an ultrasound generator, i.e. a nebulizer, which disperses them into relatively large particles 5 to 50 $\mu$m in diameter. In the second stage, the dispersion is heated to a temperature below that which would vaporize the active ingredients, but which vaporizes or otherwise activates the aerosol generating ingredient (s). Thus submicron particles are generated without evaporating and subsequently condensing the active ingredient(s). The aerosol is subjected to temperatures in the heating stage of from 50 to 400° C. Surface temperatures in the heating stage are from 200 to 600° C., preferably from 200 to 300° C.

While the prior art has proposed devices for the purpose of vaporizing substances in the absence of combustion, the present invention provides more precise and reproducible control of temperature than in the prior art. In addition, the invention provides a convenient means of controlling the time of exposure of the source material to elevated temperatures. These advantages are especially important when the compounds to be delivered by vaporization offer little margin for error between the temperature of vaporization and the temperature at which thermal degradation occurs.

Accordingly, it is an object of the present invention to produce a device and method which can accomplish vaporization of a volatile compound to make such compound available for inhalation without generating toxic or carcinogenic substances that are by-products of combustion and pyrolysis.

It is a further object to deliver controlled amounts of bio-active or flavor compounds to an individual through inhalation.

More particularly, it is an object of this invention to utilize vaporization of a volatile source material in the absence of combustion to provide an inhalation delivery system combining efficient usage of source material, accurate delivery dosage, and minimum emission of vapors into the ambient air.

It is a still further object to produce a vapor delivery system having enhanced temperature stability.

These and still further objects are described in the ensuing detailed description of the invention.

SUMMARY OF THE INVENTION

The vaporization of a volatile source material without combustion or significant denaturation of the source material is accomplished by a device comprising, in combination, a heating system which can maintain a constant temperature, a source material holder which is insertable in and removable from a chamber within the heating system, and a temperature control means which maintains the temperature of operation of the heating system substantially constant within a narrow limited range, generally within about 10° C., preferably within about 5° C., and most preferably within about 2° C.

More particularly, a device intended for use with multiple volatile source materials which vaporize at different temperatures comprises a high thermal mass heating system having one or more air flow holes extending therethrough and a temperature sensor, a volatile source material holder which fits within a chamber in the heating system when inhalation is to occur and is removed from the heating system when inhalation is not occurring, and a closed loop feedback temperature controller. Most preferably, the device further comprises a means for forcing air through the air flow holes at a controlled rate and a closed loop proportional feedback temperature control.

More particularly for a device intended for use with a single volatile source material at a single temperature, a simpler device may be used. In this case, the device comprises a high thermal mass heating system having one or more air flow holes extending therethrough, a volatile source material holder which fits within a chamber in the heating system when inhalation is to occur and is removed from the heating system when inhalation is not occurring, a constant voltage power source, and a means for forcing air through the air flow holes. A combination of a temperature sensor in the heating system and a power source having an on-off controller can be substituted for the constant voltage power source.

DETAILED DESCRIPTION OF THE INVENTION

Figure 1:
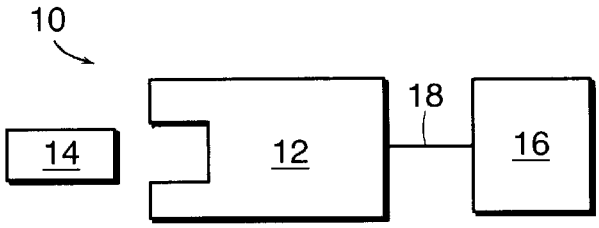
FIG. 1 is a block diagram showing the general elements of vaporization devices of this invention.

The vaporization of a volatile material without combustion or significant denaturation of the volatile material is accomplished by a device having a combination of a stable heating system, a source material holding means which is insertable in and removable from the heating system, and a temperature control means which maintains the temperature of operation of the heating system within a narrow limited range, generally within about 10° C. of a set point determined based upon properties of the volatile material. Preferably, the device maintains the temperature of operation within 5° C. of the set point. Most preferably, the device maintains the temperature of operation within 2° C. of the set point.

The vaporization devices of this invention generally combine high thermal mass to provide temperature stability, either or both of closed-loop feedback temperature control and constant air flow to achieve accurate temperature control and further promote temperature stability, and a means to quickly remove the source material from the heated area when inhalation is not taking place. By providing means for accurately and reproducibly controlling temperature, the devices of this invention allow a wide range of materials to be volatilized while avoiding combustion of the materials and of any ingredients admixed with. By providing a means for quickly and easily removing the source material from the heat source, the device ensures efficient usage of source material, accurate dosage and minimum emission of vapors into the ambient air that could be inhaled inadvertently by others.

In one embodiment, the device contains an electrical resistance heater installed in a relatively large (high thermal mass) metal body, which also comprises one or more air passages and a chamber into which a source material holder can be introduced. Adjacent to the chamber is a thermocouple to sense the temperature of the chamber. Remote from the heating device itself and connected by wires are a power supply and temperature control circuitry. The remote control unit may include a temperature display device for setting and indicating the temperature of the device.

The temperature for vaporizing a given source material is predetermined. Once set, however, the temperature of this device is precisely controlled and reproducible.

Another embodiment, designed to work at a single temperature is useful when only one source material will be used and the volatilization temperature of that material has been determined. This device also makes use of a relatively large heating structure, but has no sophisticated temperature control circuitry. Instead it is provided with a source of constant air flow, which, combined with the large thermal mass, leads to good temperature control. Low-cost pumps that can provide constant air flow at a rate comparable to or slightly less than typical inhalation rates include vibratory pumps of the sort used to aerate aquaria. Alternatively, the pump can operate such that a momentarily higher rate of flow can be induced by the user as he or she inhales, i.e. temporarily overriding the pump.

A third embodiment combines elements of both the first and second embodiments. This device, which utilizes high thermal mass, feedback temperature control, and constant air flow, offers the most precise and reproducible temperature control. Such a device is particularly useful for materials with little difference between volatilization and combustion temperatures or where the source material contains a mixture of compounds, only one of which is to be vaporized, and the combustion temperature of the unvaporized compound is close to the volatilization temperature of the desired compound.

Generally, as shown in FIG. 1, a vaporization device 10 includes a heating device 12, an insertable and removable source material delivery means 14, and a control module 16. In use, the heating device 12 is energized from a power source generally located within the control module 16 and electrically connected to the heating device 12 by flexible connector 18. The heating device 12 is energized and heats up to a pre-set steady state temperature, generally a few degrees C below the intended set point operating temperature which will be utilized for the specific source material being volatilized. When the steady state temperature is attained, an air pump (not shown), generally physically within the control module 16, can be energized, preferably automatically, and the temperature allowed to increase the last few degrees until a substantially constant predetermined operating temperature is attained. When the heating device 12 reaches the operating temperature and vaporization is to occur, the source material delivery means 14 is inserted into a chamber within the heating device 12 and a user can inhale vapors of the volatile material. After each inhalation, the user is able to remove the source material delivery means 14 from the heating device 12 so that additional vaporization does not occur until the delivery means 14 is reinserted. This minimizes contamination of the surrounding environment from the vaporized material. The control module 16 causes the chamber of the heating device 12 into which the delivery means 14 is inserted to be maintained at a substantially constant temperature, i.e. within about 10° C., preferably within about 5° C., and most preferably within about 2° C. Thus, when the user wants to inhale a second breath of vaporized source material, the delivery means 14 is reinserted into the heating device 12 which is at the operating temperature. Preferably, the delivery means 14 includes a seal means (not shown) so that a tight fit with the chamber occurs.

If the device is to be used for a single source material, then the set point and operating temperatures may be "factory set" and designed for adjustment only by service personnel. Alternatively, if the device is intended for multiple source materials or for research purposes, the temperatures can be adjustable by the user within a predetermined range. The optimum temperature of operation will depend upon the properties of the source material to be vaporized and any residual substances that are present.

Figure 2:
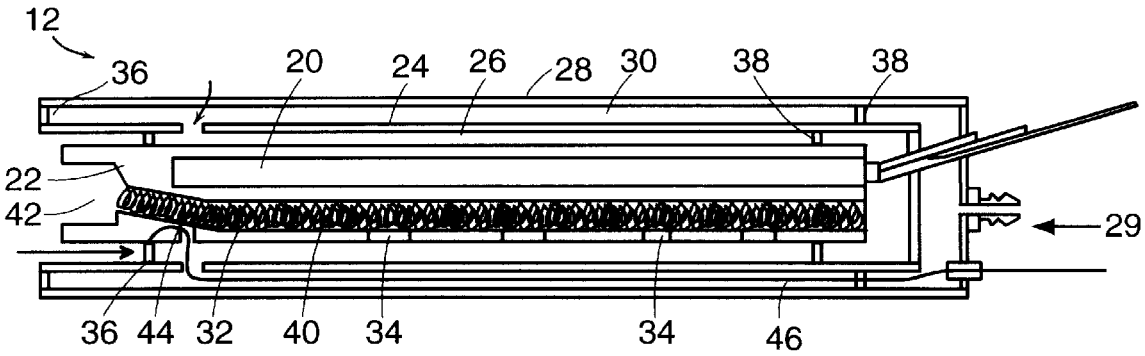
FIG. 2 is a cross-sectional view of a preferred heating system.

A suitable heating device 12 is shown in FIG. 2 and has an electric heating element 20 inserted into a metallic conduction block 22. Such heating elements are commercially available and a currently preferred heating element is a self-contained cartridge heater, such as the Hotwatt SC-18-3 (Hotwatt Inc., Danvers, Mass.). The conduction block 22 is generally made of a high thermal conductivity metal, such as copper or aluminum, although other metals such as stainless steel may also be used. The conduction block 22 is relatively large, i.e. has a high thermal mass. The mass must be sufficiently large that the device can maintain the temperature of operation within the limits specified.

The conduction block 22 is surrounded by a metallic inner case 24 which forms an inner annular space 26 therebetween. The inner case 24 is surrounded by a metallic or non-metallic outer case 28 which form an outer annular space 30 between the outer case 28 and the inner case 24. Air is caused to enter the outer annular space 30, pass through the inner annular space 26 and then through a series of air holes 34 into a central air passage 32 which allows unimpeded air flow therethrough and inhalation of vaporized material. Solid washers 36 are used to close the ends of the inner and outer annular spaces and direct the flow of air through the conduction block. Perforated washers 38 are used to provide internal support to the annular spaces while allowing the passage of air through them. As shown, the central air passage 32 is filled with copper wool 40 to improve heat transfer to the air stream. The conduction block 22 could be fabricated in a number of different geometrical forms and still provide the required heat transfer characteristics.

The heating device 12 includes a receiving chamber 42 which is shaped to receive and hold one end of the source material delivery means 14 during vaporization. A temperature sensor 44 is located in or adjacent to the central air passage 32, near the point where air emerges from the passage 32 into receiving chamber 42, thus it samples temperatures in close proximity to the point where vaporization occurs. Preferred sensors are thermocouples, but other types of sensors, such as thermistors, can be used. Temperature information from the sensor 44 is transmitted to the controller 16 via a wire 46.

The heating device 12 further includes an air inlet 29 for receiving air, either from the atmosphere or from an air pump (not shown) generally located within control module 16.

The temperature sensor 44, coupled with an electronic controller in control module 16, enables closed-loop feedback control of the temperature of the heating device and air stream.

The outer case 28 can be fabricated from an engineering thermoplastic with good elevated temperature properties such as polysulfone or polyphenylene oxide. The case, while used in air flow also is intended to allow the heating device 12 to maintain a sufficiently low surface temperatures that a user can comfortably hold the device in his or her hands. If desired, the device can be covered with a layer of insulating material such as silicone foam rubber (not shown).

Figure 3:
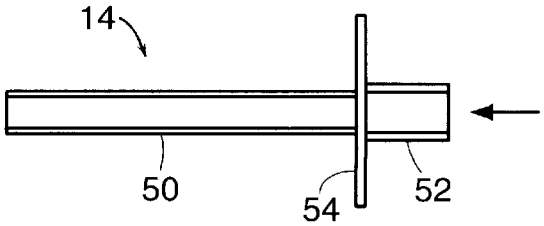
FIG. 3 is a cross-sectional view of a removable volatile source material holder.

FIG. 3 shows a preferred source material delivery means 14 having a mouthpiece 50, a source material container 52, and an air baffle 54. The mouthpiece 50, which conveys the vapors to the user, can be a simple hollow tube that can be either fabricated from or covered with a material having insulating properties so as to minimize conduction of heat to the lips of the user. The engineering thermoplastics identified for the outer case 28 are examples of suitable materials for the mouthpiece. The mouthpiece 50 may assume a number of different shapes, the main requirements being that it feel comfortable to the user and maintain a comfortable surface temperature. The source material container 52 may vary in composition and form depending upon the nature of the material to be vaporized. A general purpose embodiment that is useful for both solid and liquid forms of source material is a basket fabricated from fine wire mesh such as Tetco 50/.009/304 (Tetco Inc., Briarcliff Manor, N.Y.). Alternatively, when a device is to be used only to vaporize liquid substances, the source material container 52 may be a porous plug, e.g. a plug fabricated from sintered stainless steel or copper or a porous polymer suitable for elevated temperature use such as sintered nylon. The source material container 52 preferably has a shape which substantially completely fills the receiving chamber 42 of the heating device 12 when it is inserted therein.

The air baffle 54, shown as a flange, extends outward at the base of the mouthpiece and serves as a cover for the source material container 52 when it is inserted into the receiving chamber 42 of the heating device 12. The air baffle 54 is used to minimize/—prevent air by-passing the lumen of mouthpiece 50 during inhalation and to protect a user from the elevated temperatures of exposed portions of conduction block 22. Alternatively, the air baffle could be omitted from the source material delivery means 14 and incorporated onto the heating device 12.

A particularly advantageous method to manufacture the source material delivery means 14 is insert injection molding. In insert injection molding, prefabricated components such as a wire mesh basket or porous plug are installed in an injection mold prior to injection. Upon injection of a molten thermoplastic to form the mouthpiece 50 and the air baffle 54, the prefabricated basket or plug becomes incorporated into the final part in a single operation. The source material delivery means 14 is intended to be replacable should the source material container 52 become clogged. Alternatively, it may be designed for a single use, being sold with a measured dose of a vaporizable source material installed.

The control module 16 contains a power supply (not shown), an electronic temperature controller (not shown), and an air pump (not shown). The separate subcomponents preferably share a common housing which is connected to the heating device 12 by a flexible connector 18 or "umbilical cord" containing all necessary wires and tubes. If the combination of components is sufficiently small and/or light, they may be directly incorporated into the heating device 12 which is generally intended to be hand-held.

The power supply generally uses a step-down transformer and rectifier to produce a low-voltage DC current for operation of the electronic components and, optionally, the heating element. Alternatively, the power supply may be a battery, preferably a rechargeable one.

The temperature controller is the key element of a closed-loop feedback temperature control system which will provide the best temperature control. To accomplish closed-loop feedback control, the controller receives information from a temperature sensor 44 located in the heating device 12 at about the receiving chamber 42, compares the measured temperature with a pre-determined temperature set point, and adjusts the electrical output to heating element 20 as needed. Preferred temperature controllers are those designated as proportional controllers. In proportional control, the controller "recognizes" any deviation from the set point and proportions the corrective action to the size of the deviation. The most preferred type of temperature controller are those designated as proportional-integral-derivative or PID, an example of which is Omron E5CS (Omron Electronics, Inc., Schaumburg, Ill.). In addition to proportioning, PID controllers incorporate (i) an integral function that eliminates steady-state offset and (ii) a derivative function that is sensitive to the rate of change of deviation from the set point. The control module 16 may also include a digital display that can selectively indicate either the set point temperature or the operating temperature of the heating device.

The air pump is used to supply air at a constant flow rate to the heating device. A flexible connector 18 leads from the air pump to air inlet 29 of heating device 12. Currently preferred pumps are designed for constant flow operation in the range of about 0.5 to about 5.0 liter/min, more preferably at a flow rate of about 1.0 to about 3.0 liter/min. An example of such an air pump is the Silent-Air X4 (PenPlax Inc., Garden City, N.Y.).

The vaporization devices of the invention are useful for source materials that can be vaporized without significant decomposition of either the source material or any residues. In general, the operating temperature may be between about 100 to about 400° C. or higher, depending upon the specific compound being vaporized. Typically the operating temperature will be within the range of about 200 to about 350° C. To obtain vaporization of a given substance while avoiding combustion or denaturation of substances in the device, the operating temperature of the device and the air stream must be maintained within a very narrow range. The most preferred embodiment of described herein is capable of maintaining an operating temperature within ±1.0° C. The operating temperature is the temperature within the device that defines an upper bound on the temperature to which the source material will be exposed. Once the desired operating temperature has been determined for a given substance, the device is set to maintain that temperature regardless of variations in ambient temperature, electrical supply voltage, or user inhalation rate.

The time of exposure of the source material to elevated temperature is important. The time must be sufficiently long for vaporization to occur but not so long that denaturation can occur. The minimum exposure time is determined by the biomechanics of inhalation, i.e. the time required for a user to inhale a sufficient quantity of vapor to produce the desired effect. Generally, this will vary from about 3 to about 10–15 seconds. This invention enables the user to control the time of exposure by removal of the source material delivery means 14 from the receiving chamber 42 following each inhalation and thereby minimize unwanted vaporization and denaturation.

The following examples demonstrate the performance of a device constructed in accordance with the present invention. All parts and percents are by weight unless otherwise specified.

EXAMPLE 1

A prototype heating device was constructed in accordance with FIG. 2. Power to the heating element was controlled by an Omron E5CS controller (Omron Electronics, Inc., Schaumberg, Ill.) equipped with a type J thermocouple (Omega Engineering, Inc., Stamford, Conn.). Air was supplied at 3.0 liter/min by a SilentAir X4 air pump (PenPlax Inc., Garden City, N.Y.). The controller was set to 245° C. and the temperature of the air stream monitored over a 2 hour period by means of a thermocouple installed as shown in FIG. 2. Over this period of time, the temperature remained at 245° C. ±1.0° C.

EXAMPLE 2

The prototype device described in Example 1 was equipped with a sample holder as shown in FIG. 3 filled with glass wool, 25 $\mu$L of a 20% solution of $\Delta^9$-tetrahydrocannabinol (THC) in ethanol was applied to the glass wool and the ethanol evaporated. The device was operated at three temperatures, 220° C., 245° C., and 270° C., and two air flow rates, 3.0 liter/min and 1.0 liter/min. At each combination of temperature and flow rate, ten 5 second exposures, called "puffs", were taken. The resulting vapors were condensed in glass wool traps. The glass wool samples were extracted with ethanol and the resulting solutions analyzed using a gas chromatograph/mass spectrograph (GC/MS). All samples were run in triplicate.

The quantity of THC recovered at each set of conditions as determined by MS is shown in the Table below.

TABLE

| Flow rate | Temperature (° C.) | | |
|---|---|---|---|
| (L/m) | 220 | 245 | 270 |
| 1.00 | 50 ± 3 | 16 ± 5 | 32 ± 18 |
| 3.00 | 207 ± 8 | 349 ± 61 | 213 ± 42 |

EXAMPLE 3

The device of Example 1 was loaded as in Example 2. The temperature was set to 245° C. Air was supplied at 7 L/min under steady flow conditions for 5 minutes. In this case, 940 $\mu$g ±170 $\mu$g of THC was collected in the receiving glass wool trap. No denaturation or pyrrolysis of THC was detected.

Steve's # to call with questions:

508 553-2440 (w)

978 464-5350 (h)

What is claimed is:

1. A device for vaporization and delivery of a volatile source material without combustion or significant denaturation of the source material comprising, in combination, (i) a heating system including a means for heating and a heating chamber, (ii) a source material holder which is insertable in and removable from the heating chamber, and (iii) a temperature control means which maintains the temperature of operation of the heating system substantially constant within a range of about ±10° C. both when the material holder is in the heating chamber and when it is removed from the heating chamber during use, wherein the heating system comprises an electrical resistance heater in a metal body which is of sufficient mass to maintain the + or −10° C. temperature range and which has at least one air flow hole and is connected to a pump means which forces air through the air flow hole at an air flow rate of between about 0.5 and 5 liter per min.

2. The device of claim 1, wherein the heating chamber further includes a thermocouple to sense the temperature of the chamber.

3. The device of claim 1, further containing a power supply located remote from the heating system itself and connected thereto by wire.

4. The device of claim 3, wherein the remote power supply further includes a temperature display device for setting and indicating the temperature of the device.

5. A device for delivering multiple volatile source materials which vaporize at different temperatures by means of inhalation, which comprises (i) a high thermal mass heating system having at least one air flow hole extending therethrough and including a heating chamber and a temperature sensor; (ii) a volatile source material holder which fits within the chamber in the heating system, and (iii) a temperature controller.

wherein the heating system comprises an electrical resistance heater in a metal body which is of sufficiently large mass that it can maintain a + or −10° C. temperature range both when the volatile source material holder is within the heating chamber and when it is not within the heating chamber, and wherein the air flow hole is connected to an air pump which forces air through the air flow hole at an air flow rate of between about 0.5 and 5 liter/min.

6. The device of claim 5, wherein the source material holder is present within the chamber when delivery of the vaporized source material by inhalation is to occur.

7. The device of claim 5, wherein the source material holder is removable from within the chamber when delivery of the vaporized source material by inhalation is not to occur.

8. The device of claim 5, wherein the temperature controller is a closed loop feedback temperature control.

9. The device of claim 8, wherein the closed loop feedback temperature control is a closed loop proportional feedback temperature control.

10. The device of claim 5, wherein there are multiple air holes connected to the air pump.

* * * * *